US008869489B2

(12) United States Patent
Findlay

(10) Patent No.: US 8,869,489 B2
(45) Date of Patent: Oct. 28, 2014

(54) CRACK INDUCER APPARATUS

(76) Inventor: Donald Bruce Findlay, Buderim (AU)

( * ) Notice: Subject to any disclaimer, the term of this patent is extended or adjusted under 35 U.S.C. 154(b) by 813 days.

(21) Appl. No.: 13/124,317

(22) PCT Filed: Oct. 19, 2009

(86) PCT No.: PCT/AU2009/001377
§ 371 (c)(1),
(2), (4) Date: Apr. 14, 2011

(87) PCT Pub. No.: WO2010/043004
PCT Pub. Date: Apr. 22, 2010

(65) Prior Publication Data

US 2011/0278518 A1 Nov. 17, 2011

(30) Foreign Application Priority Data

Oct. 17, 2008 (AU) ..... 2008905392

(51) Int. Cl.

| | |
|---|---|
| ***E04C 5/16*** | (2006.01) |
| ***E04B 5/32*** | (2006.01) |
| ***E01C 11/18*** | (2006.01) |
| ***E01C 11/12*** | (2006.01) |
| ***E04F 15/14*** | (2006.01) |

(52) U.S. Cl.
CPC . *E01C 11/18* (2013.01); *E04B 5/32* (2013.01); *E01C 11/126* (2013.01); *E04F 15/14* (2013.01)
USPC ..... 52/677; 52/684

(58) Field of Classification Search
USPC ..... 52/677, 684, 687, 688
See application file for complete search history.

(56) References Cited

U.S. PATENT DOCUMENTS

| | | | | |
|---|---|---|---|---|
| 1,677,140 | A * | 7/1928 | Ketterman | 52/373 |
| 2,309,538 | A * | 1/1943 | Robertson | 404/60 |
| 2,839,973 | A * | 6/1958 | Heltzel | 404/2 |

(Continued)

FOREIGN PATENT DOCUMENTS

| | | |
|---|---|---|
| AU | 2001/89350 | 5/2002 |
| JP | 2006-57411 | 3/2006 |

OTHER PUBLICATIONS

International Preliminary Examination Report, Apr. 19, 2011.

*Primary Examiner* — Basil Katcheves
(74) *Attorney, Agent, or Firm* — Abelman, Frayne & Schwab

(57) ABSTRACT

Crack inducer apparatus including: a support body and a cracking strip fixable to the support body, the support body having: two or more mounting formations formed for mounting to separate reinforcing bar, each mounting formation being spaced from another or the other mounting formation by a predetermined spacing and being formed to prevent rotation about an axis orthogonal to the separate reinforcing bar when mounted thereto; and one or more strip fixing formations formed to accommodate fixing of the cracking strip to the support body; a trunk assembly from which the mounting formations and the or each strip fixing formations extend, each formation having a spatial disposition with respect to the other formations; the cracking strip having two opposed faces substantially parallel to one another, a straight edge along an edge of each face and one or more complementary fixing formations formed for fixing to the or each fixing formation of one or more of the support bodies, and wherein: the spatial disposition of the formations being such that the straight edge of the cracking strip is arranged substantially parallel to the separate reinforcing bars to which the mounting formations may be mounted when the cracking strip is fixed to one or more of the support bodies.

5 Claims, 6 Drawing Sheets

(56) References Cited

U.S. PATENT DOCUMENTS

| | | | | | |
|---|---|---|---|---|---|
| 3,596,421 | A * | 8/1971 | Miller | 52/333 |
| 4,522,531 | A * | 6/1985 | Thomsen et al. | 404/2 |
| 4,580,378 | A * | 4/1986 | Kelly et al. | 52/125.5 |
| 4,648,739 | A * | 3/1987 | Thomsen | 404/2 |
| 5,918,428 | A | 7/1999 | Hough | |
| 5,956,912 | A * | 9/1999 | Carter et al. | 52/396.02 |
| 6,279,274 | B1 * | 8/2001 | Amiet et al. | 52/125.2 |
| 6,893,187 | B2 * | 5/2005 | Lehto et al. | 404/47 |
| 2008/0072504 | A1 | 3/2008 | Hough | |

* cited by examiner

CRACK INDUCER APPARATUS

FIELD OF INVENTION

THIS INVENTION relates to crack inducer apparatus. The invention has particular application to crack inducer apparatus for inducing a crack to form at a desired location in a concrete slab. The invention also has application to the provision of a screed rail as an additional function of crack inducer apparatus according to the invention and to a carrier for carrying sealant for sealing a crack induced in concrete by crack inducer apparatus according to the invention.

BACKGROUND ART

When a concrete slab is poured larger than a particular size, cracks will form after setting of the concrete as the concrete cures due to unavoidable shrinkage in the concrete. For structural reasons, it is preferable for cracks to form at predetermined locations in the concrete slab. For thinner concrete formations, such as footpaths and the like, this is normally achieved by shaping a groove into the surface of the concrete with an edging tool. For thicker slabs of concrete, such an approach hardly ever works with the result cracks do not form where required and normally form where that are not required. Accordingly, a slot is normally cut into the concrete slab using a concrete cutting tool. Concrete cutting can only be carried out within a limited time frame after pouring and setting of the concrete, and is also costly, noisy, messy and not always effective. Cutting also creates a slurry which can cause environmental problems.

Once a crack has been formed in the concrete slab, even if it is propagated at a desired location, the concrete slab is no longer sealed against water transfer from one side to the other of the slab. Sealants are not normally set into in the concrete until the slab is twenty-eight days old because most of the shrinkage that the concrete undergoes occurs predominantly within such a time frame. Shrinkage normally continues significantly for twelve months or longer.

An attempt to address the issue of crack propagation has been made in the form of a crack inducer introduced into the base of a concrete slab at the time of casting. However, the cracks propagated by such a device diverge from the location of the crack inducer, and produce unsightly jagged cracks in the surface of the slab. It is almost always quite critical that reinforcing bars or reinforcing mesh be located more than a certain distance from the surface of the concrete not only to prevent spalling but also to provide maximum strength. Although bar chairs typically provide accurate spacing of reinforcing bars from the lower surface of a concrete slab, it is sometimes difficult to ensure that reinforcing bars are accurately spaced from the upper surface.

Attempts have also been made to mount crack inducers to reinforcing mesh. However, it has been found that such arrangements have undesirable effects when pouring the concrete, particularly when personnel walk through the liquid concrete mix, standing on the reinforcing mesh to which the crack inducers are mounted.

In this specification, terms reinforcing bar and the like may be taken to include reinforcing mesh, and the term reinforcing mesh is to be taken to include reinforcing bars and similar terms where the context so indicates. However, the term "separate reinforcing bar" refers to reinforcing bar which is separate from any reinforcing mesh.

The present invention aims to provide crack inducer apparatus which alleviates one or more of the problems associated with cracking of concrete slabs. Other aims and advantages of the invention may become apparent from the following description.

DISCLOSURE OF THE INVENTION

With the foregoing in view, this invention in one aspect resides broadly in crack inducer apparatus including:

- a support body and a cracking strip fixable to the support body,
- the support body having:
  - two or more mounting formations formed for mounting to separate reinforcing bar, each mounting formation being spaced from another or the other mounting formation by a predetermined spacing and being formed to prevent rotation about an axis orthogonal to the separate reinforcing bar when mounted thereto; and
  - one or more strip fixing formations formed to accommodate fixing of the cracking strip to the support body;
  - a trunk assembly from which the mounting formations and the or each strip fixing formations extend, each formation having a spatial disposition with respect to the other formations;
- the cracking strip having two opposed faces substantially parallel to one another, a straight edge along an edge of each face and one or more complementary fixing formations formed for fixing to the or each fixing formation of one or more of the support bodies, and wherein:
- the spatial disposition of the formations being such that the straight edge of the cracking strip is arranged substantially parallel to the separate reinforcing bars to which the mounting formations may be mounted when the cracking strip is fixed to one or more of the support bodies.

In another aspect, the present invention resides broadly in crack inducer apparatus including:

- a support body, a cracking strip fixable to the support body and two or more separate reinforcing bars,
- the support body having:
  - two or more mounting formations formed for mounting to the separate reinforcing bars, each mounting formation being spaced from another by a predetermined spacing and being formed to prevent rotation of the support body about an axis orthogonal to the separate reinforcing bar when mounted thereto; and
  - one or more strip fixing formations formed to accommodate fixing of the cracking strip to the support body substantially parallel to the separate reinforcing bars;
- the cracking strip having two opposed faces substantially parallel to one another, a straight edge along an edge of each face and one or more complementary fixing formations formed for fixing to the or each fixing formation of one or more of the support bodies, and wherein:
- the spatial disposition of the formations being such that the straight edge of the cracking strip is arranged substantially parallel to the separate reinforcing bars to which the mounting formations may be mounted when the cracking strip is fixed to one or more of the support bodies.

In another aspect, the present invention resides broadly in crack inducer apparatus providing a screed rail as an additional function including:

- a support body and a cracking strip fixable to the support body, the support body having:

two or more mounting formations formed for mounting to separate reinforcing bar, each mounting formation being spaced from another or the other mounting formation by a predetermined spacing and being formed to prevent rotation about an axis orthogonal to the separate reinforcing bar when mounted thereto; and one or more strip fixing formations formed to accommodate fixing of the cracking strip to the support body;

a trunk assembly from which the mounting formations and the or each strip fixing formations extend, each formation having a spatial disposition with respect to the other formations;

the cracking strip having one or more complementary fixing formations formed for fixing to the or each fixing formation of one or more of the support bodies and a straight edge spaced from the complementary fixing formations for provision of the additional screed rail function, and wherein:

the spatial disposition of the formations being such that the straight edge of the cracking strip is arranged substantially parallel to the separate reinforcing bars to which the mounting formations may be mounted when the cracking strip is fixed to one or more of the support bodies.

In another aspect, the present invention resides broadly in a sealant carrier to be embedded in a concrete casting and including one or more bonding formations by which a sealant may be bonded to the carrier, the sealant being in the form of a hydro-swellable material. The mounting of the sealant may be by application of a settable liquid or paste to the one or more bonding formations, or mounting or bonding of a preformed, resilient, elastomeric sealant to the sealant carrier.

Preferably, the cracking strip is formed as a strip of substantially constant cross section, and may be formed by such means as are available for such formation, such as an extrusion of a solidifiable material, roll forming of a sheet or sheet-like material, folding in a press brake and such like. In such form, the or each complementary fixing formation is constituted by a single complementary fixing formation running the length of the strip substantially parallel to the straight edge. Preferably, there are two mounting formations extending from the trunk assembly. Preferred that the or each fixing formation is interposed equidistant from adjacent mounting formations. In the case of two mounting formations, there is preferably a single fixing formation interposed equidistant from each mounting formation.

Preferably, the trunk assembly is includes a carriage assembly to which the cracking strip may be mounted and a support body for supporting the carriage assembly at a desired position so that the cracking strip becomes embedded at the appropriate height within the concrete slab when cast. In such form, it is further preferred that the support body incorporates height adjustment means for adjusting the height of the carriage assembly, and thereby the cracking strip, from the base of the slab to be cast. In such form, it is preferred that the height adjustment of the carriage assembly also adjusts the height of the separate reinforcing bars mounted to the trunk assembly.

The trunk assembly may also include corresponding mounting means for mounting to a separate reinforcing bar at right angles to which the other mounting formations may be mounted. It is also preferred that orthogonal mounting formations are provided for mounting the support body to orthogonal reinforcing bars, or for mounting orthogonal reinforcing bars to the support body. For such an arrangement, the orthogonal reinforcing bars when so mounted are orthogonal to the straight edge of the cracking strip and the separate reinforcing bars to which the mounting formations are mountable.

Preferably, the cracking strip includes one or more bonding formations formed to receive sealing means bonded opposed faces of the cracking strip. Suitably, the sealing means includes a strip of hydrophilic material coated with a temporary coating. The hydrophilic material is selected for desirable properties in sealing a concrete crack including materials known in the art. The material selected is preferably coated with a temporary hydrophobic coating formulated to dissolve, dissipate or disperse after a predetermined elapse of time after the installation of the cracking strip in a concrete slab.

For thicker slabs of concrete, a secondary support body may be provided. The secondary support body preferably includes secondary fixing formations in similar form to the fixing formations of the support body, and fastening formations for fastening to the base of the formwork or foundation upon which the concrete slab is to be cast. The mesh is embedded to a predetermined position, predominantly as to height, within the slab using bar chairs in the normal manner.

BRIEF DESCRIPTION OF THE DRAWINGS

In order that the invention may be more readily understood and put into practical effect, a preferred embodiment and an alternative embodiment of the present invention will now be described with reference to the following drawings, and wherein.

DETAILED DESCRIPTION OF THE DRAWINGS

Figure 1:
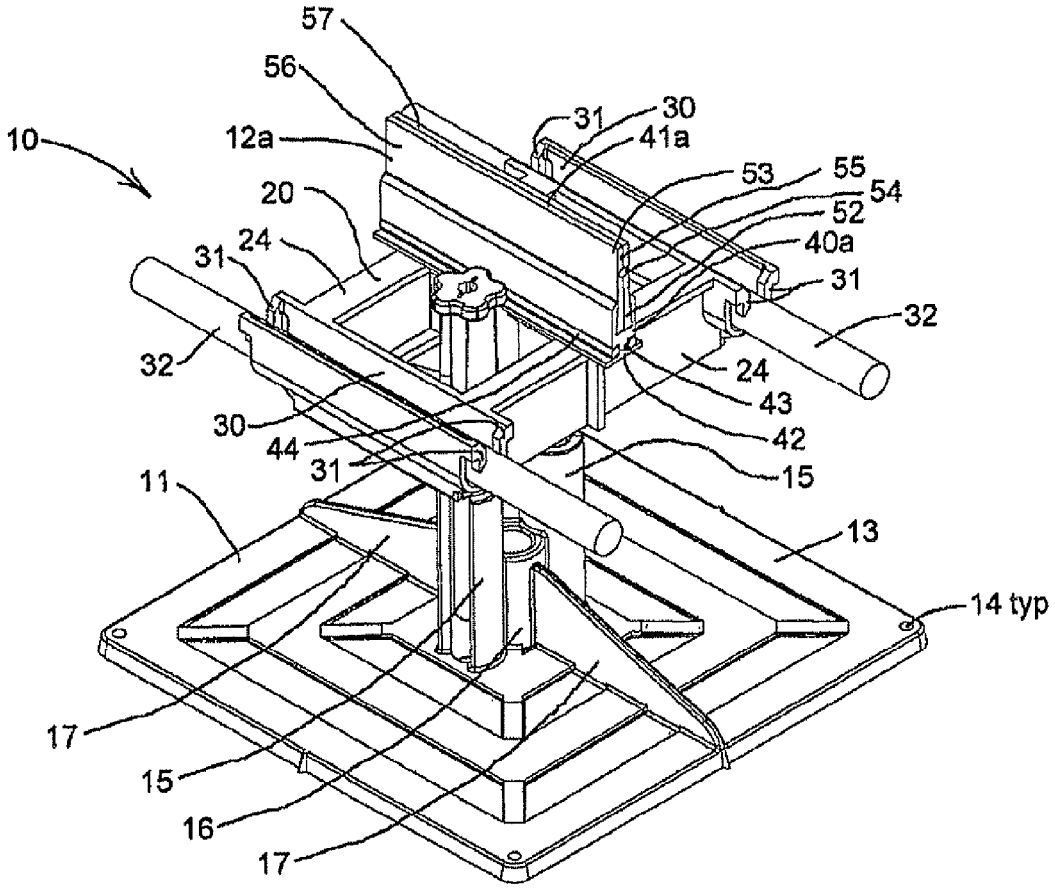
FIG. 1 is a pictorial view of crack inducer apparatus according to the invention.

In the drawings, the same reference numerals are used to indicate the same elements. However, reference numerals may be omitted in some views where their inclusion could adversely affect clarity of the disclosure.

Figure 2:
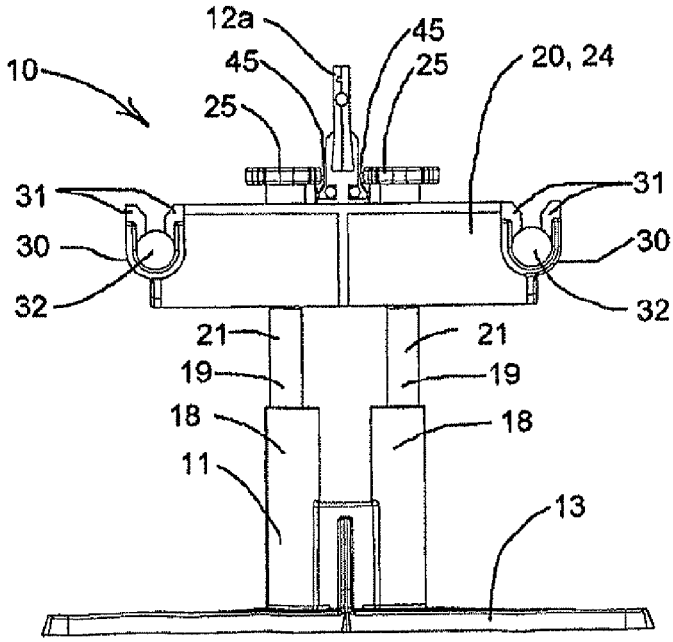
FIG. 2 is a front elevation of the crack inducer apparatus of FIG. 1.
Figure 3:
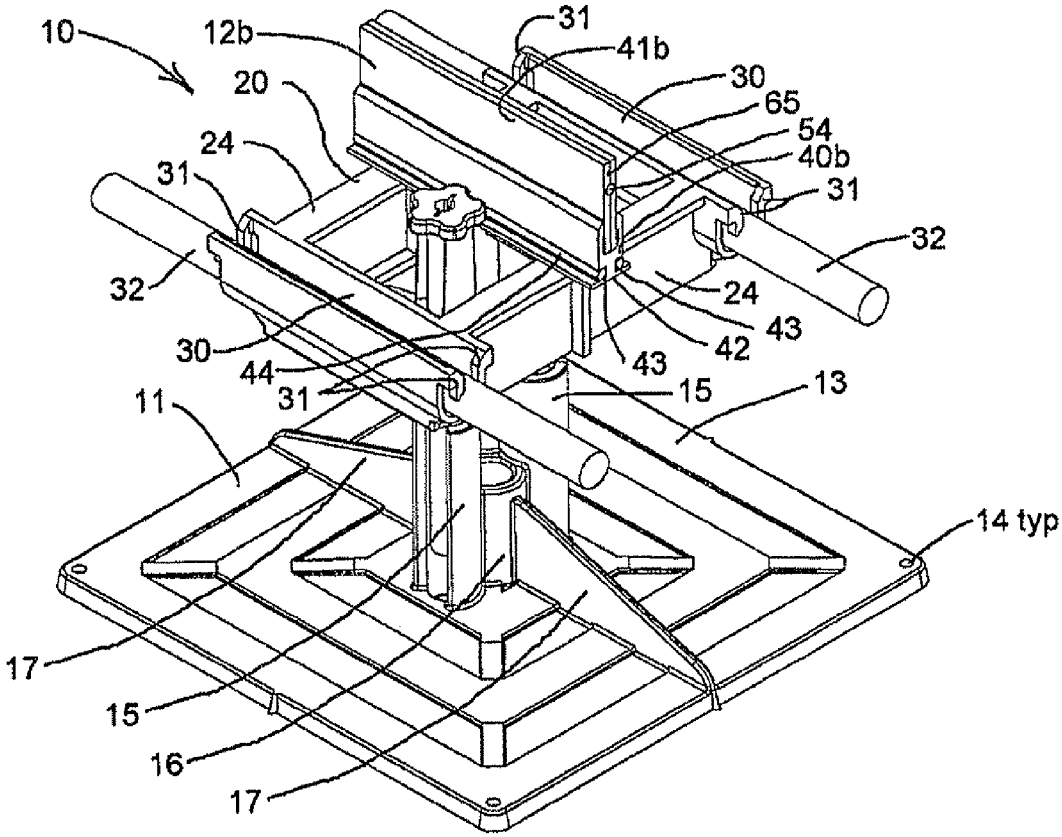
FIG. 3 is a pictorial view of the crack inducer apparatus of FIG. 1 with an alternative cracking strip.
Figure 4:
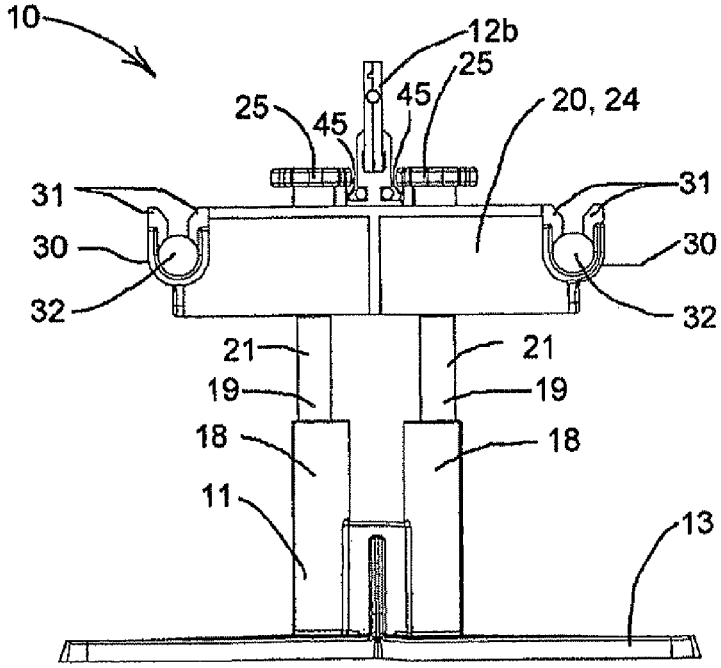
FIG. 4 is a front elevation of the crack inducer apparatus of FIG. 3.
Figure 5:
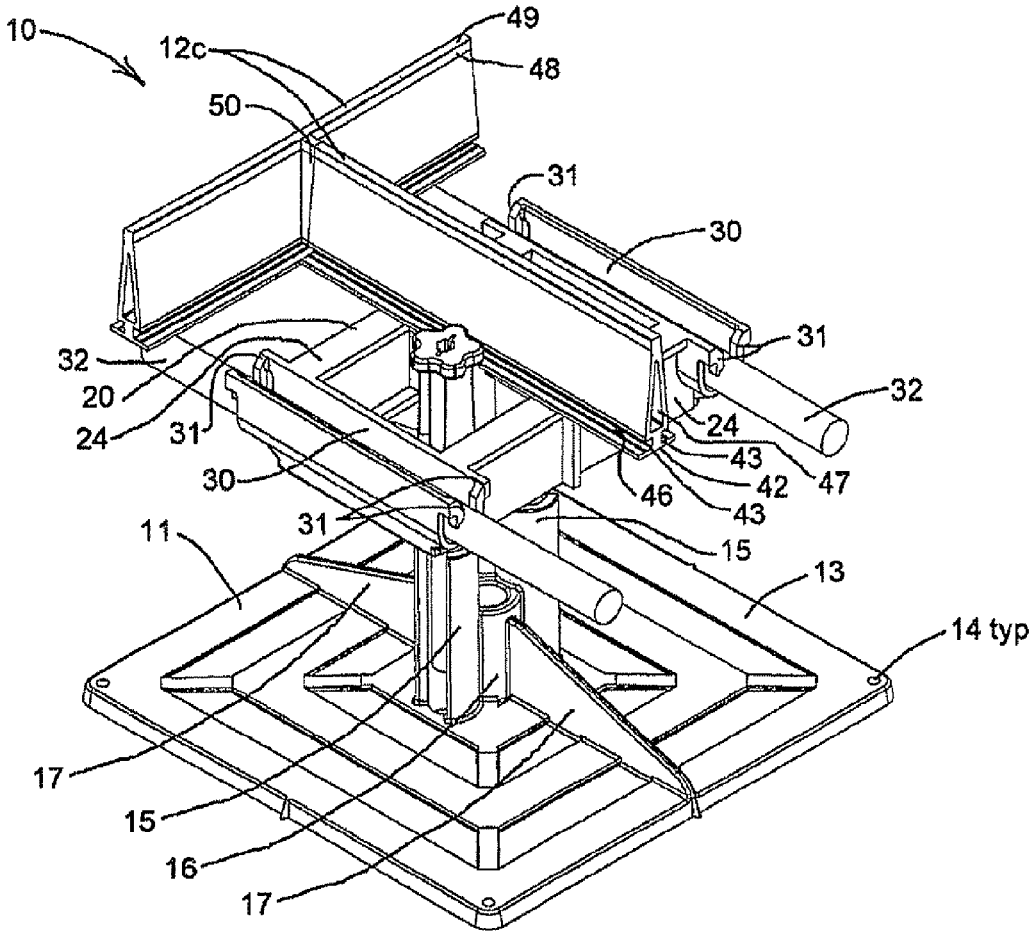
FIG. 5 is a pictorial view of the crack inducer apparatus of FIGS. 1 and 3 supporting intersecting cracking strips.

The crack inducer apparatus 10 shown in FIGS. 1 and 2 includes a support body 11 and to which a cracking strip in the form of a dovetailed cracking strip 12*a* is fixed. In similar fashion, the crack inducer apparatus shown in FIGS. 3 and 4 includes the support body and the alternative cracking strip in the form of a divided cracking strip 12*b*. The crack inducer apparatus shown in FIGS. 5 and 6 includes the support body in the same fashion as that shown in FIGS. 1 to 4 and supports intersecting cracking strips, both in the form of a hollow cracking strip 12*c*.

The support body includes a square base plate 13 which may be fastened to the base of the casting by inserting fasteners through one or more of four fixing apertures 14 near the corners of the base plate. Two support column assemblies 15 extend upward from the base plate spaced from one another about the centre of the base plate and arranged astride a hollow central column 16. The central column is supported by two webs 17 extending outward along and attached to (or integrally formed with) the base plate to opposing edges. The webs are substantially at right angles to the edges and the spacing of the support column assemblies is at right angles to the webs. The webs are substantially coplanar with the cracking strips, hereinafter referred to as the cracking plane. The central bore of the hollow central column is sized to receive a pin for aligning the base plate on the foundation or footing for the concrete slab.

Figure 7:
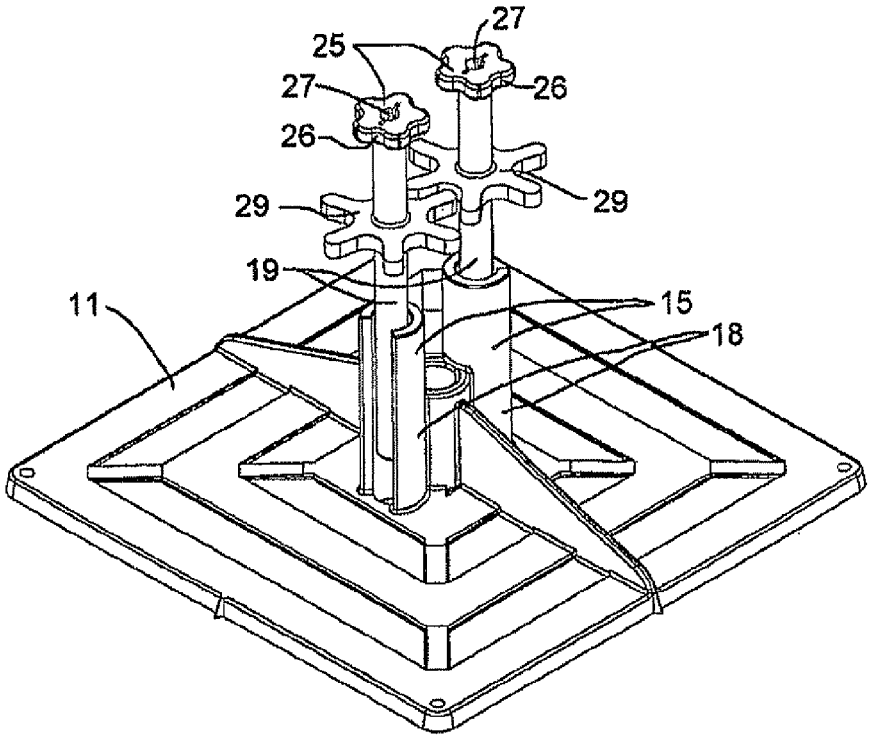
FIG. 7 is a pictorial view of a support body for the crack inducer apparatus of FIGS. 1 to 6.
Figure 8:
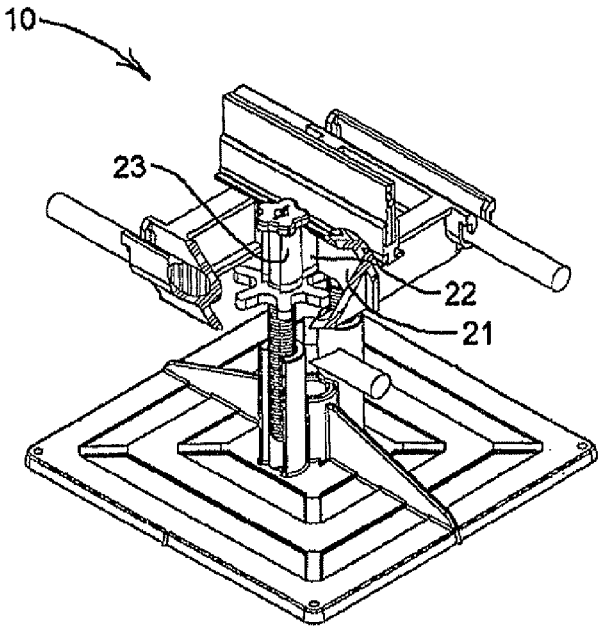
FIG. 8 is a pictorial, part cut-away view of the crack inducer apparatus of FIG. 1.
Figure 9:
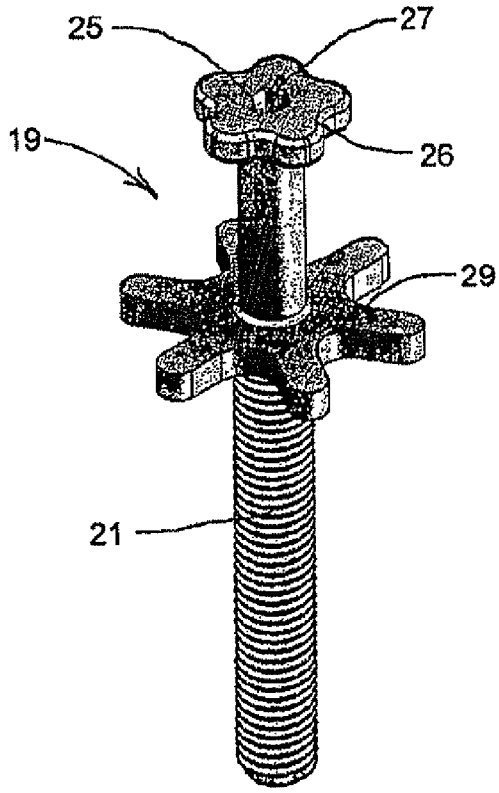
FIG. 9 is a pictorial view of an adjustment pin for the crack inducer apparatus of FIGS. 1 to 7.

The support post assemblies each include a base portion 18 and an adjustment pin 19 as can be seen more clearly in FIGS. 7 to 9. The base portion is in the form of an open sided cylinder having an internal thread. The adjustment pin includes a threaded bar portion 21 having an outer thread in complementary form to the internal thread of the base portion. The threaded bar portion is capped by a head portion 25 having a quinquilobial scalloped outer periphery 26 and a centrally located screwdriver slot 27. A cog 29 is mounted to the threaded bar portion at location where it will not interfere with the remainder of the apparatus, the cogs of each support column assembly engaging with one another so that rotation of one of the adjustment pins causes counter rotation of the other adjustment pins The thread forms provided in the base portions and on the threaded bar portions are opposite handed so that counter rotation of the adjustment pins causes axial relative movement with respect to the base portions.

A support carriage 20 includes two spaced and substantially parallel transverse members 24 extending substantially symmetrically from and substantially normal to the cracking plane. A reo bar channel 30 extends across and between corresponding ends of the transverse members, substantially in the same form for each of the opposed ends of each transverse member. The reo bar channels extend a small distance beyond the transverse members. Two retention lugs 31 are formed at each end of each reo bar channel for separate retaining reinforcing bar 32 in substantially parallel disposition with respect to the cracking strip.

The support carriage includes a connecting web 21 extending between the transverse members substantially at right angles thereto seen more clearly in FIG. 8. The intersection of the connecting web with each transverse member is substantially equidistant from each end. An intermediate web 22 extends from each side of the connecting web substantially centrally between its ends. The intermediate web terminates on each end with a support body clamping formation 23 by which the support carriage is mounted to the support column assemblies.

The cracking strips 12*a*, 12*b* and 12*c*, though slightly different in form, share some common features. The dovetailed and divided versions have a base strip and a flange strip, but the hollow version is integrally formed. For convenience the reference numerals for the parts terminate with the same letter for each kind of cracking strip as previously described herein. The dovetailed cracking strip 12*a* includes a dovetailed base strip 40*a* and a dovetail flange strip 41*a*. The divided cracking strip 12*b* includes a divided base strip 40*b* and a divided flange strip 41*b*. In the case of the hollow cracking strip 12*c*, it is integrally formed.

Figure 6:
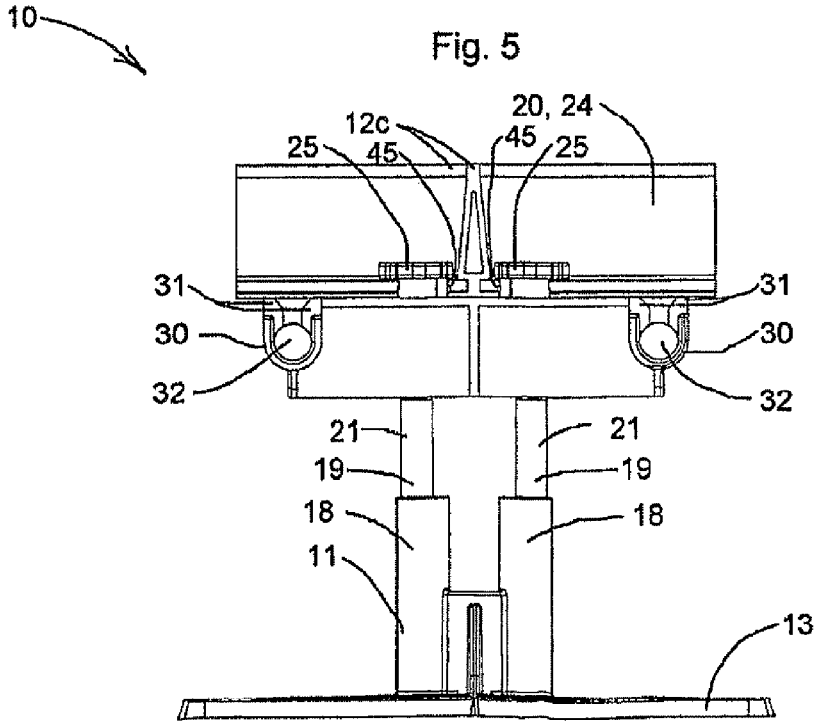
FIG. 6 is a front elevation of the crack inducer apparatus of FIG. 5.

The dovetailed and divided base strips each include in inverted T-flange 42 extending from the underside of the remainder of the base strip as does the hollow cracking strip, thereby providing outwardly opening grooves 43, one on each side, near the lower extremity of the cracking strip. The grooves are approximately square in section, the base of each groove formed by the opposed faces of the leg of the inverted "T" and the sides of each groove being formed by the top of the "T" on one side and a lower face of the remainder of the cracking strip on the other side of the groove. The inside of each groove may be engaged by opposed, inwardly directed strip retention lugs 45 shown more clearly in the front elevations of FIGS. 2, 4 and 6. The grooves also retain swellable sealant strips 44, one in and each groove and having a diametrical dimension to provide a close or interference fit in the unswelled state. The hollow cracking strip shown in FIG. 6 is drawn with the swellable material removed to show the internal detail of the grooves. A rib 46 extends along each side face of each groove to assist in the retention of the swellable material therein.

The hollow cracking strip has a hollow 47 of isosceles triangular section extending through its centre. The apex of the cracking strip is not pointed, but has a flange portion 48 having parallel opposed faces to provide a flat top 49. In order to provide for the intersection of the cracking strips, a joining section 50 is provided having a profile commensurate with the respective intersecting pieces of cracking strip.

The dovetailed base strip has a trapezoidal slot 51 having its opening outward in the opposite direction from the inverted T-flange and having inwardly sloping sides. That is, the base of the trapezoidal slot is wider than the opening. The trapezoidal slot is formed to provide a tight or interference fit to the dovetailed flange strip which has a dovetailed portion 52 along its proximal side and a parallel portion 53 along its distal side. The dovetailed flange strip is also divided substantially symmetrically into a grooved piece 56 and a ribbed piece 57. The division permits the insertion of an internal swellable strip 54 along an internal groove aligned on each side of the division between the pieces. The grooved and ribbed pieces are aligned with one another by a complementary groove and rib shown at 55 in FIG. 1.

The divided base strip has a straight-sided slot 61 having substantially parallel sides and opening outwardly in the opposite direction from the inverted T-flange. The side faces of the divided flange strip are substantially parallel and is also divided in similar fashion to the dovetailed flange strip to provide a grooved piece 66 and a ribbed piece 67. The internal swellable strip is accommodated in the same way as in the case of the dovetailed flange strip and is aligned with a similar complementary groove and rib shown at 65 in FIG. 3.

Figure 10:
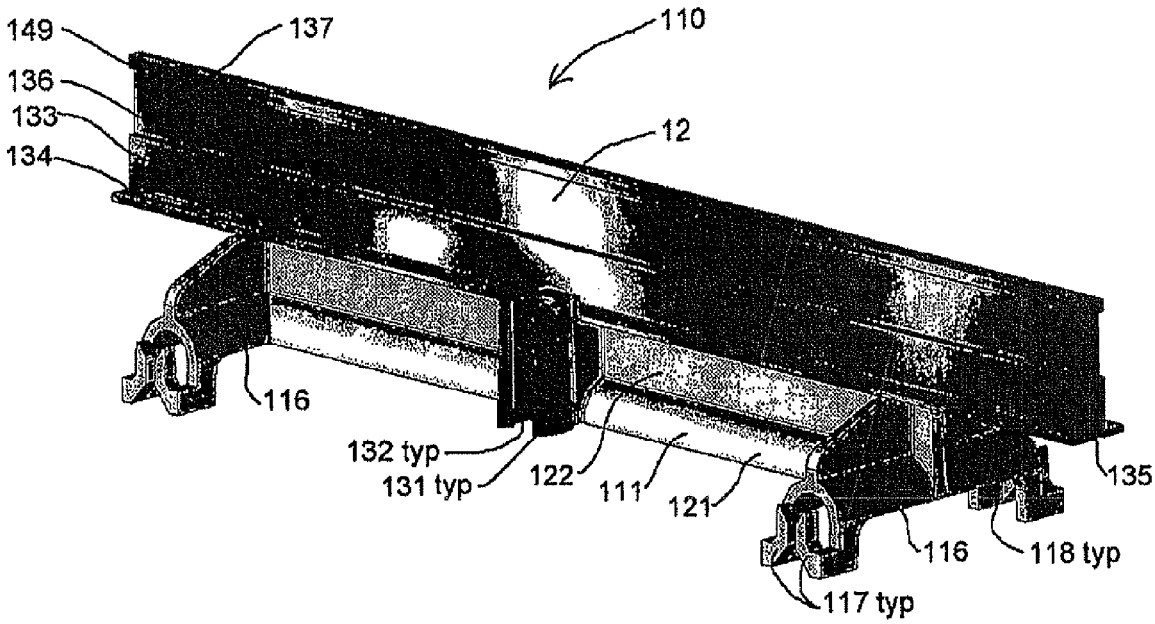
FIG. 10 is a pictorial, somewhat diagrammatic view of an alternative crack inducer apparatus according to the invention.
Figure 11:
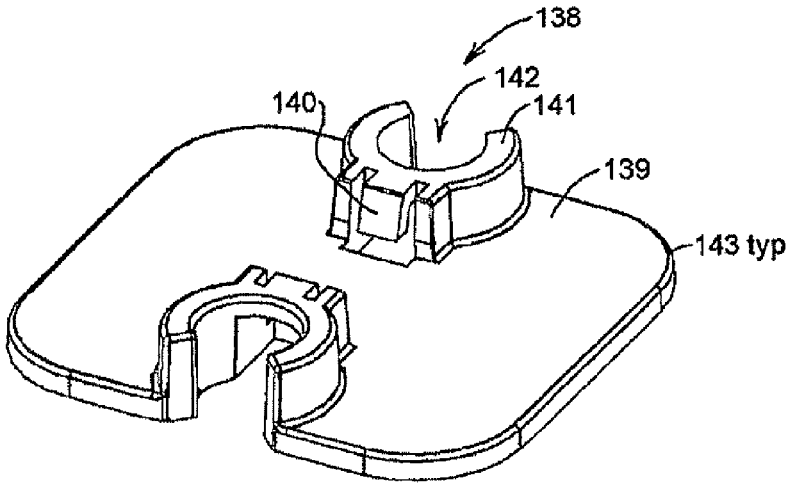
FIG. 11 is a pictorial, somewhat diagrammatic view of a secondary support body for the alternative crack inducer apparatus of FIG. 10.
Figure 12:
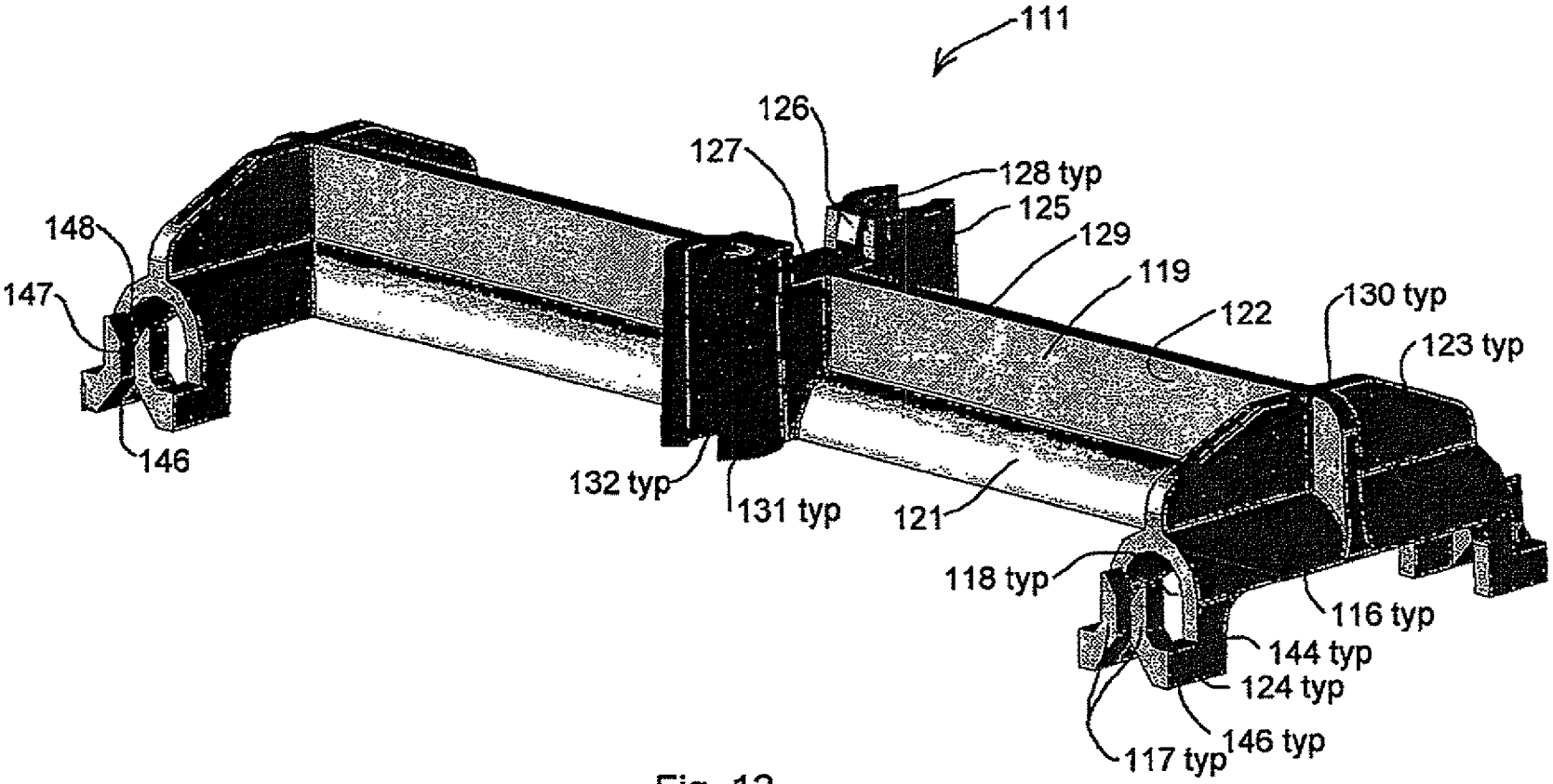
FIG. 12 is a pictorial, somewhat diagrammatic view of a support body for the crack inducing apparatus of FIG. 10.

The alternative crack inducer apparatus 110 shown in FIGS. 10 to 12 includes a support body 111, shown in particular in FIG. 10 and a cracking strip 12 fixed to the support body, the cracking strip being selected from or similar to those shown and described in respect of FIGS. 1 to 8. The support body may be supported in substantially fixed position with respect to reinforcing bar by two mounting formations 116. More specifically, the mounting formations provide a clamping action each about a respective reinforcing bar extending transverse to the cracking strip. The mounting formations are provided at opposite ends of a trunk assembly 119 of the support body. Each mounting formation has two pairs of reo clamping members shown typically at 117 for clamping the reinforcing bar into a mounting channel 118 extending through the mounting formation. The mounting channel is substantially part-circular in cross section and each mounting channel extends substantially at right angles to the trunk assembly 119.

A bridging channel 121 is provided along the underside of the trunk assembly in substantial the same cross sectional dimensions as, and intersecting with, the mounting channels formed along the mounting formations. The trunk assembly also includes a plate member 122 extending from the bridging channel such that an approximate quarter circle of the bridging channel is provided each side of the plate member which together form an inverted U in cross section. A stiffening web 123 is provided at right angles to the plate member along the outside of the inverted U of the mounting channel in similar fashion to the location of the plate member which respected to the bridging channel. The plate member extends to the ends of the support body beyond the stiffening webs to terminate at the outer extent of the walls of the mounting channels. The stiffening webs are proved in the form of a pentagon made by removing a triangular section from a rectangle partway along one adjacent sides thereof. The outer corners of the stiffening web, as well as the outer corners of the plate member are rounded. The plate member terminates at a plate edge 129 substantially parallel to the bridging channel, and the stiffening webs also terminate at a web top edge 130 substantially coplanar with the plate edge.

The reo clamping members partly occlude the mounting channels at each end of each mounting formation when in their relaxed state. Each reo clamping member extend from an L shaped lug 124 depending from the edges of the mounting channel substantially at the end thereof, the leg of the L extending tangentially and the foot of the L extending at right angles to the leg coaxially with the mounting channel. The reo clamping members may be resiliently displaced away from one another when mounting the support body to a reinforcing bar. Such resilient displacement is accommodated by torsion of the foot of each lug as well as some torsion and bending of the leg.

Each lug includes an angled face 146 which permits the reinforcing bar to displace the lugs away from one another when the reinforcing bar is inserted to the mounting channel. The angled face is provided at an angle to a parallel face 147, the parallel faces of opposed lugs in each pair of lugs being substantially parallel to one another when the lugs are in their relaxed condition. A bearing face 148 is also provided adjoining the parallel face of each lug remote from the angled face.

Two orthogonal mounting formations 131 are provided substantially centrally along the trunk assembly, one each side of the trunk assembly. Each orthogonal mounting formation is formed as a chiral opposite of the other. The orthogonal mounting formations each include an orthogonal channel 132 running substantially orthogonally to the direction of the bridging channel and the mounting channels, though not intersecting therewith. A fixing formation 125 is formed between the orthogonal mounting formation and includes a seat 127 of substantially planar form and substantially coplanar with the plate edge of the trunk assembly and the web top edge 130 of the stiffening web. The seat extends between two sides shown typically at 128. A catch member 126 projecting inwardly from each of the sides and has an angular face for engagement with the corresponding formations on the cracking strip described herein after.

The cracking strip has two opposed faces 133, one of which can be seen in FIG. 10. The faces each terminate with a flange 134 extending laterally there from, there being one flange on each side of the cracking strip. A slot 135 is provided between the flanges, and also dissecting the cracking strip partway from its underside in the orientation shown in FIG. 10. The slot extends partway into the cracking strip and with flanges together constitute complementary fixing formations for fixing the cracking strip to the fixing formation 125 of the support body. The cracking strip is fixed in an orientation substantially coplanar with and parallel to the plate member of the support body. The flanges may be resiliently displaced towards one another and/or the catch members may be resiliently displaced away from one another to permit the fixing of the cracking strip to the support body. The slot 135 allows the cracking strip to be mounted on other casting elements such as a key former.

The cracking strip also includes a recess 136 extending longitudinally and having a relatively flat face forming its base substantially parallel (in the planar sense) to the opposed faces of the cracking strip. A top face 137 is provided by a lip 149 on each side of the recess. The recess is formed to accommodate water-expandable sealant to be bonded into the recess along the length of the cracking strip.

The secondary support body 138 shown in FIG. 11 includes a square base 139 with rounded corners shown typically at 143. The secondary support body includes a secondary catch 140 having secondary orthogonal mounting formations 141 projecting inwardly from the opposed sides of the orthogonal mounting formation. Commensurate with the relationship between the orthogonal mounting formation 131 and fixing formation 125 of the support body 111, the secondary support body includes two secondary orthogonal channels formed to receive reinforcing bar in a spaced relationship and orientation with commensurate orthogonal dimensions to that described with reference to the support body.

In use, crack inducer apparatus according to the invention may be embedded in a concrete slab, having being provided in the formwork in a predetermined disposition by virtue of its mounting to reinforcing bar and the base of the formwork. Because of the fixed spatial relationship between the reo bar or mounting channels of the support body and the top face of the cracking strip, the top face of the cracking strip is provided at a disposition substantially level with respect to the main plane of the slab. As the slab is poured, the upper edge of the cracking strip can be used as a screed rail. The provision of a reinforcing bar independent from the reinforcing mesh alleviates the problem of misalignment of the cracking strip being caused by the weight of concrete workers being supported by the reinforcing mesh prior to the concrete setting. A row of pins, rods or nails may be inserted into the base or foundation for the slab aligned along the desired location for the crack to be induced in the concrete slab. The base plate may then be installed by inserting the pins through the hollow central columns 16 in the base plate, thereby aligning the base plates for receiving the remainder of the elements to form the crack inducer apparatus according to the invention at the desired location in the concrete slab.

The cracking strip may have sealant mounted to the bonding formations, the sealant being selected from materials which swell in the presence of water or aqueous liquid. Concrete casting furniture known in the art may be used as the carrier for the sealant according to the invention.

Hydrophilic material may be provided in the recess along opposed sides of the cracking strip. A hydrophilic material is preferably provided in a form which swells with moisture in order to seal the crack propagated by the cracking strip. In order to protect the hydrophilic material from swelling with wet cement prior to setting and curing, a coating is provided on the hydrophilic material which has a finite life after wetting with the water of concrete (and/or alkalinity thereof) so that the hydrophilic material become available for absorption of moisture after at least a partial curing of the concrete has taken place. When the crack inducer apparatus is installed in a formwork for pouring a slab on concrete about the reinforcing bar, bar chairs and crack inducer apparatus, the top face of the cracking strip may be used as a screed rail.

The support body and cracking strip may be formed from the same or different materials, the materials being selected for compatibility and durability when embedded in the concrete. For example, the support body may be formed by injection molding in plastics material and the cracking strip may be formed by extrusion of plastics material. A glass reinforced or mineral reinforced plastics material may be selected. The cracking strip may be formed from sheet metal by roll forming, folding in a press brake (brake press) or such like.

Although the invention has been described with reference to a specific example, it will be appreciated by those skilled in the art that the invention may be embodied in other forms within the broad scope and ambit of the invention as herein set forth and defined by the following claims.

The invention claimed is:

1. Crack inducer apparatus including:

a support body and a cracking strip fixable to the support body, the support body having:

two or more mounting formations formed for mounting to separate reinforcing bars, each mounting formation being spaced from another or other mounting formations by a predetermined spacing and being formed to prevent rotation about an axis orthogonal to the separate reinforcing bar when mounted thereto;

one or more strip fixing formations formed to accommodate fixing of the cracking strip to the support body;

a trunk assembly from which the mounting formations and the or each strip fixing formations extend, each strip fixing formation having a spatial disposition with respect to the another or the other strip fixing formations, the trunk assembly also having a carriage assembly to which the cracking strip may be mounted, and a support body for supporting the carriage assembly at a desired position, the cracking strip having two opposed faces substantially parallel to one another, a straight edge along an edge of each face, and one or more complementary fixing formations formed for fixing to the or each strip fixing formation of one or more of the support bodies, wherein a spatial disposition of the strip fixing formations and of the complementary fixing formations being such that the straight edge of the cracking strip is arranged substantially parallel to the separate reinforcing bars to which the mounting formations may be mounted when the cracking strip is fixed to one or more of the support bodies, and wherein the support body incorporates height adjustment means for adjusting a height of the carriage assembly and, thereby, of the cracking strip from a base of a slab to be cast.

2. Crack inducer apparatus according to claim 1, wherein the cracking strip provides a screed rail as an additional function to the crack inducer apparatus.

3. Crack inducer apparatus according to claim 1, and including a sealant carrier having one or more bonding formations by which a sealant may be bonded to the carrier, the sealant being in the form of a hydro-swellable material.

4. Crack inducer apparatus according to claim 1, wherein the or each complementary fixing formation is constituted by a single complementary fixing formation running the length of the strip substantially parallel to the straight edge.

5. Crack inducer apparatus according to claim 1, wherein the height adjustment of the carriage assembly also adjusts a height of the separate reinforcing bars mounted to the trunk assembly.

* * * * *